United States Patent [19]

Mongeau

[11] 4,059,738

[45] Nov. 22, 1977

[54] MULTI-POSITION SWITCH ASSEMBLY HAVING PLURAL OPERATOR WITH PRIMARY AND SECONDARY DETENTED CAMS

[75] Inventor: Roland E. Mongeau, Cumberland, R.I.

[73] Assignee: Tower Manufacturing Corporation, Providence, R.I.

[21] Appl. No.: 689,518

[22] Filed: May 24, 1976

[51] Int. Cl.[2] ..... H01H 19/62; H01H 3/42

[52] U.S. Cl. ..... 200/6 B; 200/6 BB; 200/153 LB; 200/303

[58] Field of Search ..... 200/1 R, 5 R, 6 R, 6 B, 200/6 BA, 6 BB, 6 C, 17 R, 18, 27, 30 R, 38 B, 38 BA, 38 C, 38 CA, 153 L, 153 LA, 153 LB, 283, 153 V, 303; 318/252

[56] References Cited

U.S. PATENT DOCUMENTS

| | | | |
|---|---|---|---|
| 2,786,905 | 3/1957 | Sibbald | 200/6 BB X |
| 2,960,580 | 11/1960 | Aquillon | 200/6 BB |
| 3,373,252 | 3/1968 | Ghaem-Maghami et al. | 200/153 |
| 3,621,157 | 11/1971 | Schwab | 200/153 LB X |
| 3,627,937 | 12/1971 | Swanke et al. | 200/153 V X |
| 3,725,624 | 4/1973 | Emmons | 200/153 LB X |
| 3,792,206 | 2/1974 | Purdy | 200/6 B |

*Primary Examiner*—James R. Scott
*Attorney, Agent, or Firm*—Salter & Michaelson

[57] ABSTRACT

A multi-position switch comprising a housing which positions and generally encloses a rotator having a plurality of axially spaced cam tracks provided with collective, circumferentially staggered primary recesses for cooperating with detent portions of resilient conductors also positioned within the housing and in operational contact with the rotor so that the several circuits of the device may be selectively activated by the engagement of a selected conductor with a common contact. Each of the rotor cams is further provided with a plurality of intermediate, secondary recesses for resilient engagement with the remaining conductor detents so as to assure the switch will not become inadvertently positioned between contact positions thereof, and to further impart a more positive feel to the rotor as it is moved through its multiple positions by the appliance operator. The housing also includes means in the form of a longitudinally oriented bar for simultaneously urging the resilient conductors toward contact engaging position with the common contactor terminal.

11 Claims, 9 Drawing Figures

MULTI-POSITION SWITCH ASSEMBLY HAVING PLURAL OPERATOR WITH PRIMARY AND SECONDARY DETENTED CAMS

BACKGROUND OF THE INVENTION

Switches of the present type which permit multi-speed operation of household appliances, such as food mixers and the like, are well known. One such switch and the environment in which it is utilized is disclosed in U.S. Pat. No. 3,725,624 issued Apr. 3, 1973, and as such, is representative of the present state of the art of such switch designs. Such switches include frame components, a rotor and a plurality of identical conductor blades each having a generally V-shaped detent intermediate the extent thereof which serves to activate various speed-control circuits by engaging cam recesses staggered around the rotor so that each switch may be closed while the others are held open. Where the speed selector circuit includes diode means, each rotor cam is provided with two diametrically opposed cam recesses, one series of recesses operating in combination with a high 180° cam land of an added cam surface, and the other series operating in combination with the low-cam profile on the remaining 180° periphery thereof. An added high-low cam surface of this type serves to double the available speeds otherwise provided by such coil control switches. The operational mode of such switches and their manner of use in home appliances of the aforementioned type may be seen by specific reference to the aforementioned patent.

Disadvantages of prior art switches generally include their lack of a positive feel between speed positions, and the undesirable possibility that the switch may become lodged or hung up between selected speed positions on the rotor while the main circuit is activated, whereby a person, erroneously thinking the switch is in "off" position, may move the rotor into operative position while cleaning beaters or the like, hence raising the danger of physical injury.

In addition, previously known switch constructions of this type usually require that the conductor blades be plated with a nonoxidizing, highly conductive metal, such as silver, in order to achieve the necessary conductivity that the higher rating outputs require of such devices. Highly conductive materials such as silver are extremely expensive, and it would accordingly be desirable if the same operating outputs could be achieved using unplated copper or brass conductor blades. It is also desirable that the speed-selection rotor of switches of the type here under consideration be so constructed that the amount of force necessary to turn the rotor be equal in either direction. Furthermore, in the manufacture and assembly of such prior art switches, the resilient conductor blades thereof are normally pre-stressed so as to achieve the correct force engagement with a common conductor so as to achieve the required power ratings. In many cases, however, the contact pressure of the blades may be undesirably reduced by repeated use of the switch or by annealing of the blades that may take place by heat generated during assembly, such as by ultrasonic welding or the like. It is therefore desirable to provide means to maintain proper contact pressure and to eliminate or lessen the other stated shortcomings of known prior art switches of the type here under consideration.

SUMMARY OF THE INVENTION

The present invention overcomes these prior art shortcomings and provides a modified switch having improved safety and operational characteristics by the use of an improved rotor design incorporating, in addition to the collectively circumferentially staggered primary recesses formed in the surface of a plurality of axially spaced, generally circular cam tracks, a plurality of spaced peripheral secondary recesses of lesser depth than said primary recesses. This results in a series of circumferential cam tracks, each having alternating peaks and valleys on the peripheral surfaces thereof, each cam track having a pair of generally opposed primary recesses, with the remainder of each track comprising a plurality of secondary recesses around its periphery. Conductor blades supported by the switch housing are aligned in proper position with respect to said rotor whereby rotation of the latter to any one position results in one blade engaging a primary recess, in which position said one blade contacts a stationary contactor to close that particular circuit. Means carried by the housing continuously urge said blades toward their aligned cam track to insure firm resilient engagement between said blades and their aligned primary and secondary recesses.

It is therefore a primary object of the present invention to provide a switch assembly wherein a more positive feel is imparted to speed-control knobs associated therewith so that it is unlikely that the rotator element thereof can be undesirably positioned between different contact speeds thereof when the appliance is powered.

Another object of the present invention is the provision of a switch device wherein a direct pressure is applied to all of the conductor blades thereof and which pressure may be varied so as to assure achievement of the desired power ratings for a variety of appliances utilizing such switches.

A still further object of the present invention is that of entirely mechanically orientating and positioning the several conductor blades so as to eliminate the necessity of exposure thereof to high heat sources.

Other objects, features and advantages of the invention will become apparent when the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
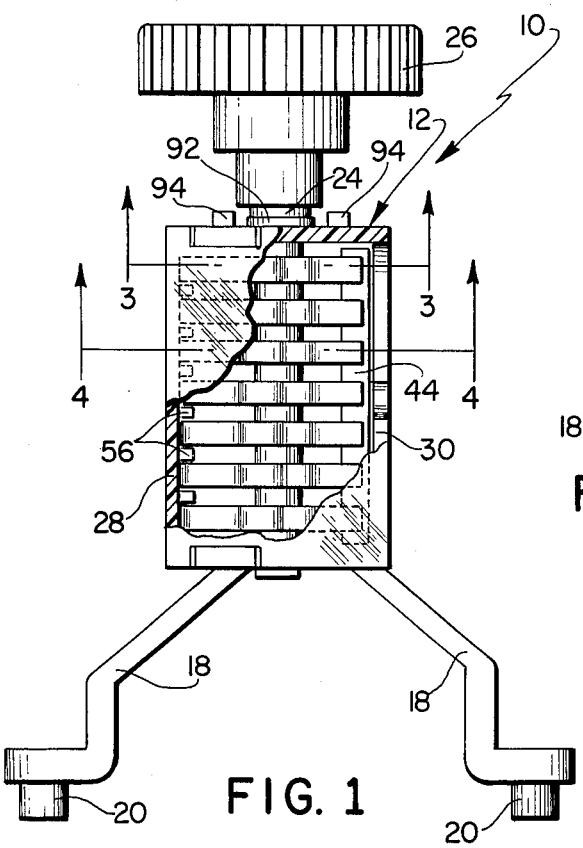
FIG. 1 is a front elevational view, with parts broken away for clarity, shown a switch embodying the present invention.
Figure 2:
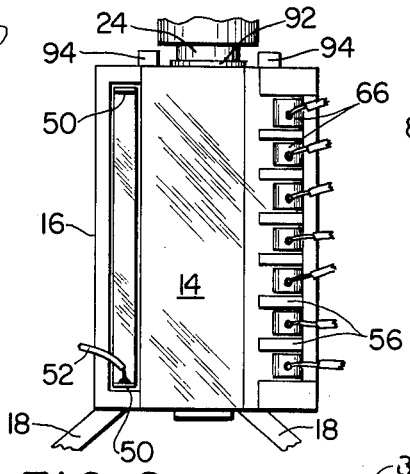
FIG. 2 is a partial bottom view thereof.

Turning now to the drawing, a switch 10 embodying the features of the present invention is depicted. The switch 10 includes a housing 12 made up of a base member 14 and a cover member 16. A pair of spaced legs 18 extend downwardly from the base housing member 14 so as to fixedly orientate, as by conventional fastening means through the footed pad portions 20 thereof, the switch within the housing of an appliance, such as a food mixer or the like, not shown. In such position, the housing 12 is adapted to generally enclose a rotor member 22 journalled therein, as will hereinafter be more fully explained, and having a shaft portion 24 upwardly projecting therefrom and in turn provided with a knob member 26 fixedly mounted thereon by any suitable means. Such knob may be the speed-selection dial of an appliance and accordingly projects outwardly from the housing thereof, thus enabling the appliance user to rotate the rotor 22 through various positions thereof so as to select varying appliance speeds. The housing 12 may be molded of suitable plastic materials, such as clear high-impact polystyrene or the like, so that the contact assembly located therein will be readily visible for ease in repair.

Base member 14 includes a pair of side walls 28 and 30, respectively, and an opposed pair of end walls 32. Each of said end walls is provided with a U-shaped slot 34 longitudinally aligned along the extent of the base member 14 and thus adapted to receive the outwardly extending shaft portion 24 of rotor 22. The rotor shaft 24, which may be hollow as depicted, includes a plurality of circular and axially spaced cams 36 each having one or more primary recesses 38 peripherally staggered with respect to adjacent cams 50 that only one speedselection switch will be closed at a time, although it will be understood that any desired number of switches may be closed at one time by appropriate arrangement of the primary recesses, should it be necessary or desirable to simultaneously energize more than one circuit, for any reason. Between each such primary recess 38, a plurality of secondary recesses 40 of a shallower depth are provided so as to present a cam surface having alternating peaks 41 and valleys (38, 40). Side wall 30 is further provided with inwardly directed shelf 42 serving to position a stationary multiple-contact bight portion 44 of a U-shaped switch element 46 having terminal legs 48 downwardly extending through openings 50 disposed between the shelf 42 and the opposed end walls 32. A wire lead 52 is connected to one of the legs 48 as at 54 and serves to electrically connect a variable speed-control motor for controlling the appliance speed, as is known.

Figure 4:
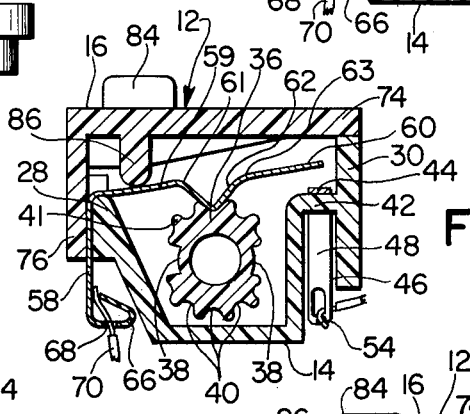
FIG. 4 is a side sectional view taken along line 4—4 of FIG. 1 depicting the detent of that conductor shown in engagement with one of the secondary recesses on the peripheral contact surface of a rotor cam.
Figure 5:
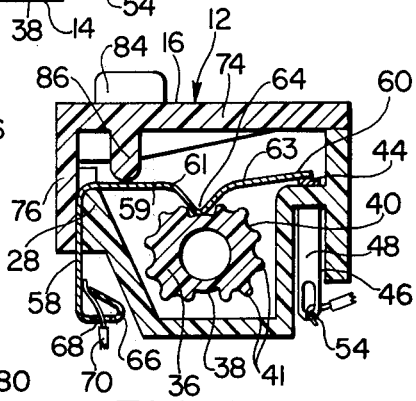
FIG. 5 is a side sectional view taken along the same plane as FIG. 4 but wherein the rotor has been moved to a position where one of its primary recesses engages the conductor detent so that the conductor engages a common conductor bar so as to close a selected speed circuit.

Side wall 28 of the base member 14 is provided with a series of hollow slots 56 spaced from each other extending across the top surface thereof in castellated fashion. A series of generally L-shaped switch conductors 57 having a leg 58 and arm 59 are adapted for insertion in each of said slots 56 with the arm 59 thereof adapted to bridge the open end of the base member 14 to enable the free ends 60 thereof to cooperate as switch armatures in alternatively engaging the stationary contact 44. In such position the conductors 57 are disposed above the rotor and are provided intermediate the generally flat arm portion 59 thereof with a downwardly orientated, generally symmetrical V-shaped notch 62 which forms a detent 64 adapted to ride in one of the recesses 38 or 40 provided at the peripheral surface of the cams 36. It should be noted that although the notch 62 is symmetrical so that the resultant friction and thus the force to override detentrecess engagement will be generally equal with knob movement in either direction, the angle at which said notch joins the arm portion 59 is preferably sharper, i.e., having a more pronounced juncture bend 61 at that end proximal the leg portion 58 thereof than its juncture 63 with the terminal portion 60. This configuration enhances independent lever action of terminal arm portion 60 which is beneficial for the reason that it permits maximum detent pressure to exist between detent 64 and cam 36 when detent 64 is in a primary recess 38. The terminus of the leg portion 58 of each blade 57 is further provided with a reverse bend 66 having an opening 68 therein to receive the bared wire of conductor 70 in frictional contact therebetween, as is best shown in FIGS. 3 to 5.

It will be apparent that when the detent 64 of a particular conductor 57 is positioned in a primary recess 38, the detents of the remaining switch conductors will be positioned in a secondary recess, unless, of course, it is desired to close more than one circuit at the same time. Thus, the switch conductor in the primary recess is permitted by its lowered position to contact the stationary contact 44 to close a particular circuit, while the remaining switch conductors 57 by reason of their engagement in the shallower secondary recesses 40 are maintained out of engagement with the stationary contact 44. In this manner then not only is single-speed appliance selection accomplished, but, furthermore, by reason of the inability of the detent 64 to be positioned or hung up on the relatively sharp peaks 41 disposed between the recesses 38, 40, no possibility exists, as sometimes happens with prior art switches, of the energized switch hanging up between positions, whereby the user of the appliance may erroneously think the motor is off, which could create a safety hazard if one were to attempt to clean the appliance with the switch so positioned. Also, with each speed turn of the knob 26, each detent 64 engages a recess 38 or 40 and is required to ride over the peaks 41, thus giving a more positive positioning and feel or click to the speedselection rotor, which better enables the operator of the appliance to more positively judge the various different function positions thereof.

Figure 3:
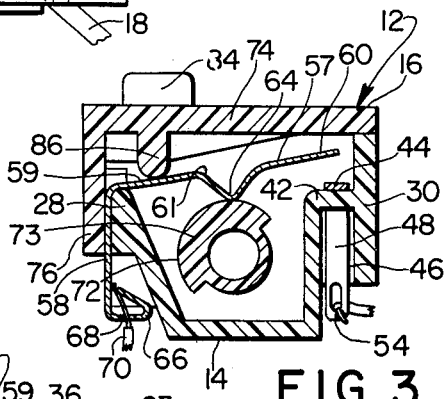
FIG. 3 is a side sectional view taken along line 3—3 of FIG. 1.

In order to double the number of different electrical positions obtainable by the present switch, one of the switch conductors 57, as shown in FIG. 3 of the drawing, is adapted to ride on or off an initial differently shaped cam 72 having a semi-circular lobe 73 to contact the stationary contact 44 during one-half turn of the shaft 34 and be maintained out of contact therewith for the remaining half-turn. In this way, the number of different electrical positions can be doubled; that is, with the six switch conductors shown in the drawing which activately break or make circuits, twelve different circuits may be selected.

Figure 8:
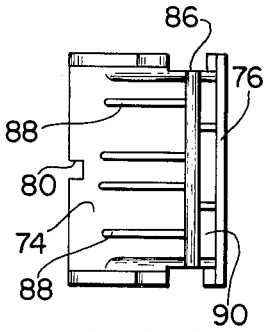
FIG. 8 is an interior plan view of the cover portion of the housing assembly.

The cover portion 16 of the housing 12 is provided with a top wall 74, a downwardly dependent side wall 76 at one side thereof, and a pair of aligned end wall projections 78 at opposite edges 79 thereof. The side of the top wall 74 opposite side wall 76 includes a notch 80 for cooperation with an upstanding post 82 provided on side wall 30 of base member 14. Also, a pair of orientated slots or inlets 83 formed by the spacing between side wall 76 and the end wall extensions 78 are adapted for receipt of the guide posts 84 positioned at either end wall 32 and projecting upwardly therefrom. Cover 16 is further provided with an inwardly, downwardly extending rib 86 longitudinally extending thereacross and serving to engage the arm portions 59 of the switch conductors 57 at a location intermediate the leg 58 and notch portions 62 thereof. In this manner, when the cover 16 and base 14 are in assembled position, the rib 86 serves to force the conducotrs 57 against the rotor 22, and when a particular detent 64 thereof is positioned within a primary recess 38, against the stationary contact 44. This serves to increase the contact pressure between the electrical contact portions of the switch thereby reducing electrical resistance and enabling higher currents to be transmitted without the need for using highly conductive contact portion coatings. This construction permits the use of plain copper or copper-alloy conductors 57 and avoids the higher cost of coating the contact portions with silver or the like. It will also be apparent that the positioning of the rib 86 can be varied along the length of the conductor 57 as well as varying its downward extent so as to vary the applied contact load imparted to such conductors thereby. As will also be seen, the cover side wall 76 snugly engages the upstanding wall portions 28 disposed between the slots 56 and that such cooperation firmly and wholly mechanically supports and positions each conductor 57 firmly in place. The use of such mechanical orientation of the conductors eliminates the need for riveting them in place which requires added parts and process costs, as well as the use of heat-application techniques, such as wave soldering, which, as has been previously indicated, could adversely anneal the conductors 57 and thus alter their flexibility and spring action. In addition, the cover member 16 as best shown in FIGS. 7–8 includes a plurality of reinforcing ribs 88 and a pocket 90 formed between the side walls 76 and the rib 86 for receipt of the upstanding castellated portions of the wall 28 between the slots 56 disposed therein. When the base 14 and cover portions 16 of the housing 12 are assembled in contact with each other, the end wall extensions 78 are received in the U-shaped slots 34 provided at either end of the base and are of an extent so as to positively contact the shaft 24 and thus journal the rotor 22 there within, wherein the rotor, while free to rotate, is otherwise maintained against movement. It will be understood that when base and cover portions 14, 16 are in assembled interfitting relation, the assembly is secured by fusing the overlapping end portions together, as shown at 91 in FIG. 7. Specifically, the posts 84 of base 14 overlap the recessed wall of slot 83, while at the same time portions 96 of cover 16 (see FIG. 6) overlap the edges 98 of side wall 30. Although heat is applied to effect this fusion, the specific location at which the heat is applied is sufficiently far removed from the conductor blades 57 so as not to adversely affect them. As previously stated, no riveting, welding or other fabricating is required since the conductor blades are securely mounted between the cover and base sections of the housing, as heretofore described. This not only reduces manufacturing and assembly costs, but also avoids exposure of the conductor blades to excessive heat, such as might cause undesirable annealing of said blades.

Figure 6:
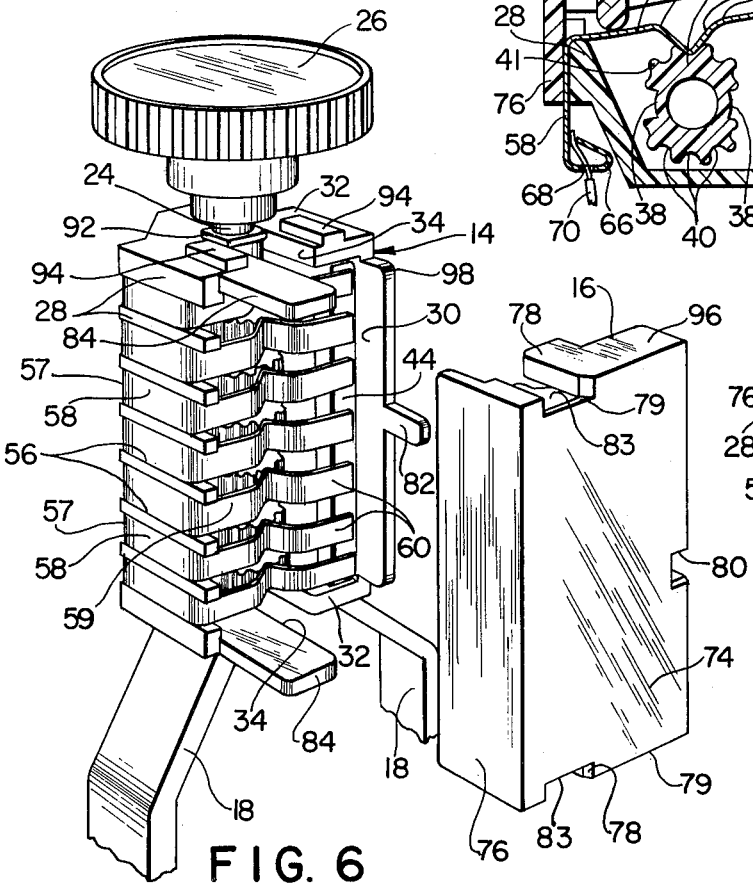
FIG. 6 is an exploded perspective view of the switch similar to FIG. 1 with the cover portion of the housing withdrawn to better show the manner in which it cooperates with the base portion of the housing.
Figure 7:
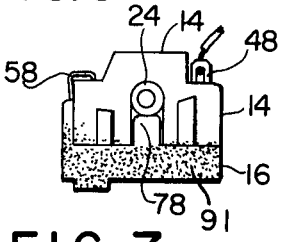
FIG. 7 is an end view on a reduced scale of the switch assembly housing of the present invention showing the manner in which the rotor shaft is journalled therein.
Figure 9:
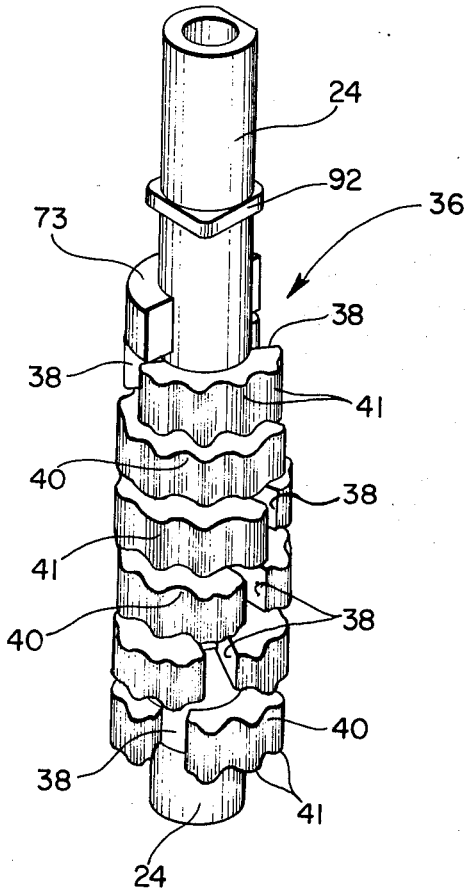
FIG. 9 is an enlarged perspective view showing the construction of the cam having alternating peaks and valleys

Also, and as best shown in FIG. 6 of the drawing, a square-holed washer (not shown) having an outwardly extending lug may be fitted over the squared portion 92 provided at the upper end of the shaft 24 for rotation therewith as knob 26 is turned. As will be apparent, the outwardly extending lug will contact stops 94 at either side of the end wall 32 to limit the rotation of the shaft 24. It will be apparent that such a washer is only utilized when it is desired to reduce the number of electrical selections capable with a particular switching device, and is useful to reduce the inventory of switches required to accomplish these means.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A multi-circuit switch for use with household appliances and the like comprising a generally enclosed housing, a rotor journalled at the ends thereof and generally enclosed by said housing and adapted for at least partial rotation with respect to said housing, a plurality of generally parallel resilient conductors supported by said housing transversely thereto and in contact with said rotor, said rotor intermediate the ends thereof having a plurality of axially spaced circumferential cams collectively having circumferentially staggered primary recesses, each of said cams further having a plurality of spaced peripheral secondary recesses of lesser depth than said primary recesses so as to form cam surfaces having alternating peaks and valleys, each said conductor having an intermediate detent portion thereof to selectively engage said primary recesses successively so that upon rotation of said rotor to any position thereof, at least one of said detents engage a primary recess and the remaining detents engage a secondary recess, said housing including stationary contact means for selective engagement by said conductors when the detent thereof engages a primary recess.

2. The switch construction set forth in claim 1, wherein the positioning of the detents of said remaining conductors in said secondary recesses maintains said remaining conductors in spaced relation with said stationary contact means.

3. The switch construction of claim 2, wherein said conductor detents are of symmetrical V-shaped configuration whereby resistance to rotor turning is equal in either direction.

4. The switch construction of claim 2, wherein said secondary recesses are equidistantly spaced about the periphery of each said cam surface and wherein said intermediate peaks terminate in a relatively sharp configuration, said peaks forming insufficient contact with said detents for stable positioning of said rotor thereon.

5. A multi-circuit switch for use with household appliances and the like comprising a housing including a first housing member having opposed upstanding end and opposed upstanding side walls, a rotor journalled at the ends thereof in said end walls and adapted for at least partial rotation with respect to said housing, said rotor intermediate the ends thereof having a plurality of axially spaced circumferential cam tracks, a stationary contact supported along one of said side walls, a plurality of generally parallel resilient switch conductors supported by the other of said side walls at a first end thereof and outwardly extending to means intermediate the ends thereof for contacting said cam track positioned in alignment therewith and terminating in a contact at the other end thereof in position to engage said stationary contact, and a second housing member cooperating with said first housing member to generally enclose said switch, said second housing member including means for contacting upper portions of said conductors intermediate said first end and said cam track contacting means for simultaneously urging said switch conductor contact ends into engagement with said stationary contact, said conductor cam track contacting means serving to hold a plurality of said switch conductor other ends out of contact with said stationary contact at any given time.

6. The switch set forth in claim 5, wherein said means for urging said switch conductors against the stationary contact includes a downwardly extending longitudinally orientated bar positioned proximal the other of said side walls.

7. The switch set forth in claim 6, wherein said stationary contact is supported on a longitudinally orientated shelf inwardly projecting from said one side wall, and wherein the outwardly directed surface of said other side wall includes a plurality of open-end spaced slots for engaging said one end portions of said switch conductors, said second housing member including a downwardly extending wall contacting said outwardly directed surface so as to enclose said one end portions of said switch conductors.

8. The switch set forth in claim 6, said first housing end walls having open slots for receipt of said rotor ends, said second housing member including means cooperating with said slots to journal said rotor ends in said housing.

9. The switch set forth in claim 5, each of said conductors having a generally flat intermediate portion spanning said side walls and interrupted by a downwardly orientated V-shaped detent.

10. The switch set forth in claim 9 wherein said detent is generally symmetrical and connecting with said flat portion in a larger smoother radius at that end proximal the stationary contact than at that end downwardly urged by said bar.

11. The switch construction of claim 9, each of said cam tracks collectively having circumferentially staggered primary recesses and a plurality of spaced peripheral secondary recesses of lesser depth than said primary recesses thereby forming cam surfaces having alternating peaks and valleys, wherein contact of a particular conductor detent in one of said primary recesses permits contact between said other end of said particular conductor with said stationary contact.

* * * * *